US008250682B2

(12) United States Patent
Mjelde et al.

(10) Patent No.: US 8,250,682 B2
(45) Date of Patent: Aug. 28, 2012

(54) DIRECTIONAL WATER FLOW EXTENDER

(76) Inventors: Olaf W. Mjelde, San Diego, CA (US); Wade H. Arens, Jr., Rancho Santa Margarita, CA (US)

( * ) Notice: Subject to any disclaimer, the term of this patent is extended or adjusted under 35 U.S.C. 154(b) by 1225 days.

(21) Appl. No.: 11/784,444

(22) Filed: Apr. 5, 2007

(65) Prior Publication Data

US 2008/0244822 A1 Oct. 9, 2008

(51) Int. Cl.
*E04H 4/00* (2006.01)

(52) U.S. Cl. ..... 4/492; 4/490; 4/541.1; 4/541.6; 285/220; 285/221

(58) Field of Classification Search ..... 4/490, 492, 4/541.1, 541.6; 285/219, 220, 221, 379
See application file for complete search history.

(56) References Cited

U.S. PATENT DOCUMENTS 771,306 A * 10/1904 Gregg ..... 285/8
846,905 A * 3/1907 Bruen ..... 277/607
2,766,054 A * 10/1956 Everhart ..... 285/230
2,788,992 A * 4/1957 De Vienne et al. ..... 285/136.1
4,422,191 A * 12/1983 Jaworski ..... 4/496
4,717,078 A * 1/1988 Arp ..... 239/550
6,322,004 B1 * 11/2001 Perdreau et al. ..... 239/428.5
6,375,232 B1 * 4/2002 Robinson ..... 285/220
2005/0050627 A1 * 3/2005 Ayeni et al. ..... 4/541.6
2005/0193486 A1 * 9/2005 Ciechanowski et al. ..... 4/559

* cited by examiner

*Primary Examiner* — Gregory Huson
*Assistant Examiner* — Erin Deery
(74) *Attorney, Agent, or Firm* — Robert J. Lauson; Lauson & Tarver LLP

(57) ABSTRACT

A pool and spa plumbing adapter to relocate existing directional water flow plumbing fittings to new positions to accommodate new surfacing overlaid on the existing pool or spa surface. The adapter provides for a threaded engagement with existing plumbing and has a shoulder portion providing a visual cue for proper rotational translation of the adapter into the existing plumbing fitting to accommodate the new surface layer. A sealing ring can be provided extending above the shoulder portion to prevent fluid passage between the new surface and the adapter and to prevent rotation of the adapter.

18 Claims, 1 Drawing Sheet

DIRECTIONAL WATER FLOW EXTENDER

CROSS-REFERENCE TO RELATED APPLICATIONS

This application claims priority from U.S. Provisional Patent Application Ser. No. 60/789,848 filed Apr. 5, 2006.

FIELD OF THE INVENTION

The invention herein disclosed relates to directional water flow jets or inlets for pools, ponds, and spas. More particularly it relates to a device and method for providing an easily employed extension for fixed plumbing engagements for directional water jets or "eyeballs" mounted on the sidewall of a pool or spa. The device allows for re-plastering or surfacing of the swimming pool or spa without the need to damage the old plaster around threadably engaged water jets as is currently done.

BACKGROUND OF THE INVENTION

Conventional pools, spas, ponds, and similar artificial water holders are conventionally formed by plaster or other cementitious material covering the side and bottom walls defining the pool or spa. Upon initial construction of the pool or spa, earth is excavated to form the appropriate shaped cavity for the pool or spa to occupy. Side and bottom walls are then formed using appropriate reinforcing means, along with plaster which forms the side and bottom wall of the pool or spa.

The plumbing to remove and add water to the pool or spa is engaged at distal ends into the plaster in a permanent fashion substantially flush with or slightly recessed from the plaster surface of the sidewall. To these distal ends are attached the various covers for the drains and the inlets or jets which bring water back into the pool or spa. In the case of spas, some of these inlets or jets are equipped with a user rotatable water fluid flow director which rotates in an engagement with a base fitting. The base fitting is permanently engaged to the pipe or water conduit feeding the jet incoming water under pressure.

In the case of flow directors, a rotatable flow director is engaged in a cavity formed in a flush mount with the plaster and is held into a rotational engagement within the cavity by a threadably engaged locking ring. The center of the body of the rotationally positionable flow director communicates water therethrough which may be aimed by rotating the flow director.

Unfortunately, in conventional construction the flush mounted retaining cavity does not allow for easy re-plastering of the pool or spa. Consequently, owners and contractors are left with little choice but to chip out the old plaster around the pipe engaging the flow director, and install pipe extensions to the existing plumbing. The extensions relocate the engagement cavity for the flow director extended from the old plaster surface. New plaster must then be placed to surround the destroyed material around the engagement cavity fitting increasing cost and potential for leaks at a later date.

Suffice it to say that this requirement to remove the old plaster and to cut or otherwise disturb old plumbing is the cause of extra costs in time and money. Further, the disassembly of old plumbing fixtures can cause leaks or cracks in the plumbing itself which will not be discovered until the new surface has been applied and the pool or spa put back into operation with pressurized water.

As such, there is an ongoing need for an extension adapter fitting that will allow relocation of the fluid flow director cavity away from the old plaster surface of the pool or spa, without the need to disassemble the existing plumbing pipes and fixtures. Such a device should obviate the need to destroy or damage existing plaster. Such a device should easily engage with a wide variety of such flow director cavities which are employed to house rotationally engaged fluid flow directors. Still further such a device should provide an easily viewed visual cue for the installer to determine the proper installation of the fitting to accommodate the thickness of the new plaster and concurrently position the new flow director substantially flush with the new surface. Additionally, it would also provide more utility if the adapter provides a seal engageable with the new plaster to prevent water leakage and/or to hold the adapter in a fixed sealed engagement with the preexisting plumbing fixtures.

With respect to the above description, before explaining at least one preferred embodiment of the invention in detail, it is to be understood that the invention is not limited in its application to the details of construction and to the arrangement of the components or steps set forth in the following description or illustrated in the drawings. The various apparatus and methods of the invention are capable of other embodiments and of being practiced and carried out in various ways which will be obvious to those skilled in the art once they review this disclosure. Also, it is to be understood that the phraseology and terminology employed herein are for the purpose of description and should not be regarded as limiting.

Consequently, those skilled in the art will appreciate that the conception upon which this disclosure is based may readily be utilized as a basis for designing of other devices, methods and systems for carrying out the several purposes of the present disclosed device. It is important, therefore, that the objects and claims be regarded as including such equivalent construction and methodology insofar as they do not depart from the spirit and scope of the present invention.

Further objectives of this invention will be brought out in the following part of the specification, wherein detailed description is for the purpose of fully disclosing the invention without placing limitations thereon.

SUMMARY OF THE INVENTION

The device herein disclosed and described provides an easily engaged interface and extension fitting that is adapted on a first end with threads. These threads are adapted to engage interior threads on the distal end of existing permanently mounted plumbing which is flush with the old plaster of a pool or spa. The threads of the device extend from an angled sealing edge adjacent to a raised collar portion, to an annular projecting portion having a diameter smaller than the outside of the threads. The projecting portion provides a means to adapt the extension fitting to engage a wide variety of existing threaded pipe installations from different manufacturers all of whom extend the internal threads different distances in the already installed cavity rotationally engaging a flow director.

Also provided on the extension fitting is a raised shoulder portion. This shoulder portion has a defined width of the intended thickness of the new plaster coating being applied to the old plaster forming the sidewall and bottom wall of the pool. It thus provides an easily viewed visual cue to the installer of the distance to thread the extension fitting into the old cavity which was originally installed to rotationally engage the old flow director. In cases where the extension fitting cannot be screwed all the way into the old fitting, a sealing compound or PVC or other cement can be applied to the external threads on the extension fitting that will provide a sealed engagement once the glue or cement cures with the old plastic fitting. In other cases, the extension can be screwed all the way into the old fitting and the beveled edge next to the shoulder portion will provide a water-tight seal with the front edge of the old fitting. The installer simply uses the visual cue provided by distance of the exterior surface of the shoulder to determine how far to screw the extension fitting into the old fitting. Of special utility, the shoulder can be made a variety of widths depending on the thickness of the new surface with ½ inch being a current-favored embodiment. Thus, if local building codes, or material installation requirements dictate a thinner or thicker surface, a component with a different collar width would be employed making it easy for the user to install and accommodate the thickness requirements of the new surface.

On the opposite side of the extension fitting from the threaded first end, an internal cavity is provided that is adapted to rotationally engage the flow director behind a lock ring which has threads adapted to engage with threads formed in the internal cavity. This allows for the repositioning of the flow director at a new position, a distance from its old position, to allow for re-plastering of the pool.

Finally, one or a plurality sealing rings may be provided extending from the circumference of the outside surface of the shoulder portion. These sealing rings would thus extend away from the center axis of the device and project into the surface of the new plaster that surrounds the shoulder upon the re-plastering of the pool or spa. The sealing ring provides a means to seal water from flowing past the extension fitting and plaster engagement once the new plaster is set. It also increases the surface area of the shoulder engaging the new plaster helping to prevent rotation of the extension fitting should glue or adhesive not be employed on the threads.

An object of this invention is to provide a universally engageable flow director extension fitting to eliminate the need to disassemble old pool or spa plumbing during a re-plaster of the surface of the pool or spa.

Another object of this invention is to provide such an extension fitting that also provides a visual cue to the installer of proper mounting of the fitting to accommodate the thickness of the new plaster.

An additional object of this invention is the provision of such an extension fitting that also provides a water seal to prevent water from breaching the gap between the adapter and the new plaster.

Yet another object is the provision of such an extension fitting that comes with a variety of collar thickness dimensions to accommodate different thicknesses of coatings adjacent thereto.

These together with other objects and advantages which become subsequently apparent reside in the details of the construction and operation as more fully hereinafter described and claimed, reference being had to the accompanying drawings forming a part thereof, wherein like numerals refer to like parts throughout.

BRIEF DESCRIPTION OF THE ASSOCIATED DRAWINGS

DETAILED DESCRIPTION OF PREFERRED EMBODIMENTS OF THE DISCLOSED DEVICE

Figure 1:
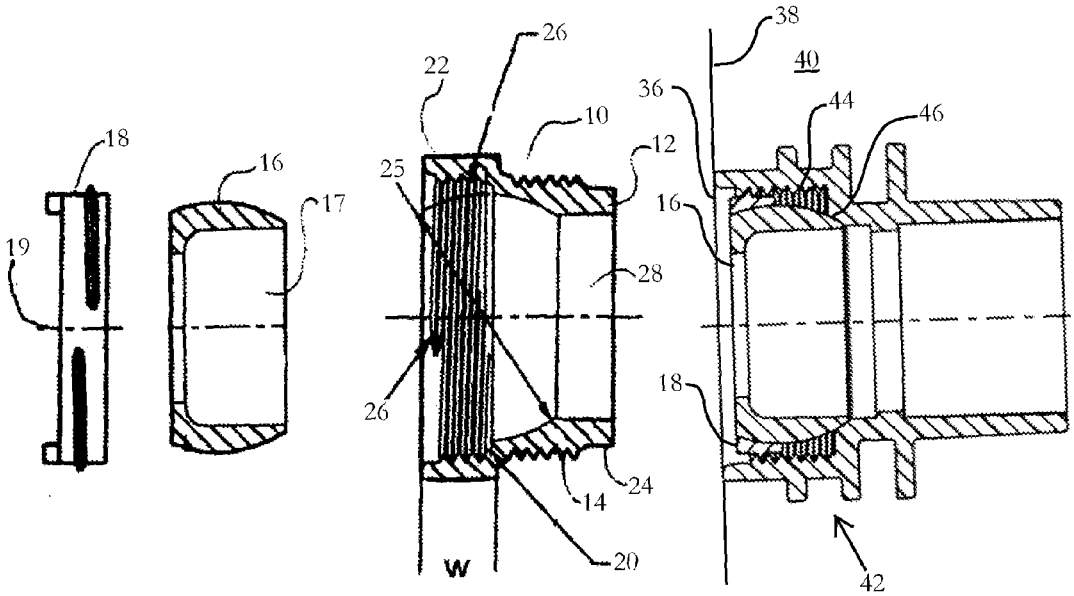
FIG. 1 is a side sliced view of the extension fitting device in exploded view showing a threaded end and the flow director and locking ring.
Figure 4:
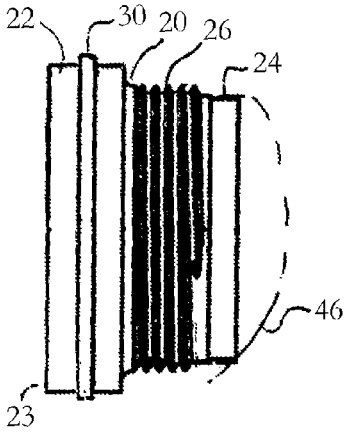
FIG. 4 depicts a side view of the extension fitting with at least one sealing ring extending from the shoulder portion.
Figure 2:
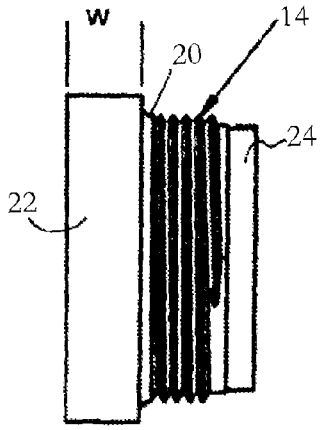
FIG. 2 depicts a side view of the exterior of the extension fitting.
Figure 3:
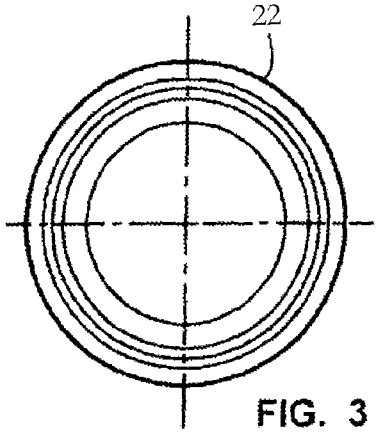
FIG. 3 is an end view of the extension fitting showing the internal cavity surrounded by shoulder.

Referring now to the drawings, FIGS. 1-4 disclose the preferred embodiments of the extension fitting device 10. As shown in the figures, the device 10 provides an easily engaged extension fitting 12 which is adapted on a first end with threads 14. These threads 14 are sized to engage existing extending threads or base socket threads 44 adjacent to the distal end of the inside wall of the existing permanently flush-mounted plumbing fixture or base fitting 42, which holds the existing flow director or directional ball type nozzle 16 behind a locking ring 18 in a globular internal cavity or base socket 46 of the existing base fitting 42. A current preferred thread is 111/2 TPI threads which are widely employed. The base fitting 42 is permanently embedded within a pool wall and has an outlet 36 that is substantially flush with the initial surface 38 of the pool wall. The base fitting 42, locking ring 18, and flow director 16 are standard in the spa and pool industry. Once the locking ring 18 and the flow director 16 have been removed from the base fitting 42, the extension fitting device 10 can be threaded into the base fitting 42.

The threads 14 on the first end extend from a beveled edge 20 to a rear side of a collar portion 22, to a threadless projecting portion 24 having a diameter smaller than the outside diameter of the threads 14. The projecting portion 24 is preferred as experimentation shows it to provide a means to adapt the extension fitting 12 to engage a wide variety of existing threaded pipe installations from different manufacturers since each varies the distance of the internal threads which engage the existing locking ring. When the fitting 12 is fully threaded into position with the beveled edge 20 in a sealed engagement with the front wall (not shown) of an existing fitting, the projecting portion 24 also provides a means to seal the first end of the device against the sidewall forming the existing globe shaped internal cavity holding the existing flow director 16.

As noted, in the preferred embodiment of the device 10 a shoulder portion or extending portion 22 is provided which has a defined width "W" of a raised annular ring which has a width of the intended thickness of the new plaster coating to be adhered to the old plaster forming the sidewall of the existing pool or spa. The width of the shoulder portion 22, thus provides a means for a visual indicator to the installer of how far to thread the extension fitting 12 into the exiting threads of the existing cavity which rotationally engages the old flow director behind an existing locking ring. This can be done by using a ruler or other measuring device to measure the distance of the intended thickness of the new coating, and screwing the shoulder portion 22 such that the outside edge 23 is the distance of the intended new wall coating. In cases where the extension fitting 12 cannot be screwed all the way into the old fitting to seat the beveled edge 20 which also is a stop, a sealing compound or PVC or other cement can be applied to the external threads 14 on the extension fitting that will provide a fluid sealed engagement. In other cases, where the coating and outside edge 23 will properly align, the extension fitting 12 might be screwed all the way into the old fitting and the beveled edge 20 will provide an additional means for a water-tight seal with the old fitting if glue is used, and a single means for a water-tight installation should plastic cement or glue not be used. The device can be custom manufactured with the width "W" in a variety of sizes to accommodate thicknesses of the new surface. Currently, ½ inch for the width "W" is a favored embodiment.

On the end opposite the threads 14 of the extension fitting 12 is formed an internal cavity 24 communicating with the axial cavity 28 which communicates through the extension fitting 12. The internal cavity 24 is defined by a curved sidewall 25 adapted to rotationally engage the curved surface of the flow director 16. The flow director 16 has an axial passage 17, and is rotationally engaged in the cavity 24 behind a lock ring 18 with a center aperture 19 aligned to communicate with the axial passage 17. Ring threads 26 are formed on a linear section of the internal cavity 24 to engage with cooperating external threads on the locking ring 18 as a means for threaded engagement thereof. Engagement of the locking ring 18 maintains the flow director 16 in a rotational engagement in the internal cavity 18 along two axes and at the proper distance from its old position with the existing plumbing to accommodate the new plaster surface of the pool or spa.

Finally, in another preferred mode of the device 10, one or a plurality of optional sealing rings 30 may be provided. The sealing rings 30 extend outward from the circumference of the shoulder 22 substantially perpendicular to its flat surface. Extending in this manner, once the extension fitting 12 is properly engaged to the existing plumbing, the new plaster or other surfacing is applied and thereby surrounds the shoulder 22 and the sealing ring 30 upon the re-plastering of the pool or spa. The sealing ring 30 thereby provides a means to seal water from flowing between the new plaster surface and the extension fitting 12 once the new plaster is dry. The sealing ring 30 also increases the surface area of the shoulder 22 engaging the new plaster thereby providing means for increased surface engagement to thereby prevent rotation of the extension fitting 12 should glue or adhesive not be employed on the threads 14 in engagement with the old existing plumbing.

Although the invention has been described with respect to particular embodiments thereof, it should be realized that various changes and modifications may be made therein without departing from the spirit and scope of the invention. While the invention as shown in the drawings and described in detail herein discloses arrangements of elements of particular construction and configuration for illustrating preferred embodiments of structure and method of operation of the present invention, it is to be understood, however, that elements of different construction and configuration and other arrangements thereof, other than those illustrated and described, may be employed in accordance with the spirit of this invention. Any and all such changes, alternations and modifications as would occur to those skilled in the art are considered to be within the scope of this invention as broadly defined in the appended claims.

Further, the purpose of the attached abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

What is claimed is:

1. An extension fitting for attachment to a base fitting permanently embedded within the wall of a pool and configured for delivering a fluid to the pool, the base fitting having an outlet substantially flush with an initial surface of the wall, the base fitting having a base socket proximate to the outlet for receiving a directional ball type nozzle retained therein by a locking ring, the extension fitting comprising:

a first end configured for insertion into the base socket after removal of the locking ring and the directional ball type nozzle from the base socket;

an extending portion proximate a second end;

a passage formed axially through the extension fitting fluidly communicating between the first end and the second end to permit the flow of water exiting the base fitting to flow into the first end and exit the second end; and a socket configured to receive the directional ball type nozzle held therein by the locking ring;

wherein when the first end of the extension fitting is inserted into the base socket the extending portion is configured to extend above the initial surface of the wall;

and wherein a plaster-based resurfacing material layer is applied atop the initial surface to embed the extending portion so that the second end is substantially flush with a new surface of the plaster-based resurfacing material.

2. The extension fitting of claim 1 wherein at least a portion of the socket comprises a curved sidewall configured to engage the directional ball type nozzle.

3. The extension fitting of claim 1 wherein the socket comprises a curved sidewall configured to engage the directional ball type nozzle and a socket thread configured to engage the locking ring.

4. The extension fitting of claim 1 wherein a sealing projection is formed on an outer surface of the extending portion and configured to project into the resurfacing material for increasing contact area between the extension fitting and the resurfacing material.

5. The extension fitting of claim 4 wherein the outer surface has an outer diameter and the extending portion is an annular projection formed about the outer diameter.

6. The extension fitting of claim 1 wherein an outer diameter thread is formed between the first end and the extending portion and is configured to threadably engage a base socket thread formed within the base socket.

7. The extension fitting of claim 6 wherein an annular bevel is formed between the extending portion and the outer diameter thread and configured for sealed engagement with the outlet of the base fitting.

8. The extension fitting of claim 6 wherein the base socket thread is configured to threadably engage the locking ring, the outer diameter thread on the extension fitting configured to engage the base socket thread when the locking ring and the directional ball type nozzle are removed from the base fitting.

9. The extension fitting of claim 1 wherein an annular bevel is formed proximate the extending portion between the extending portion and the first end and configured for sealed engagement with the outlet of the base fitting.

10. The extension fitting of claim 1 wherein a width of the extending portion may be varied such that a desired thickness of resurfacing material may be applied.

11. The extension fitting of claim 1 wherein a tube like projecting portion is formed at the first end.

12. The extension fitting of claim 11 wherein the tube like projecting portion is configured to guide the first end into engagement with the base socket and the tube like projecting portion configured to contact the base socket of the base fitting and form a seal therebetween.

13. The extension fitting of claim 1 wherein the pool is one of a swimming pool, a spa, and a pond.

14. A method of resurfacing an initial surface of a wall of a pool having a base fitting permanently embedded within the wall and the base fitting having an outlet and a base socket in fluid communication with the outlet, the method comprising the steps of:

providing an extension fitting having a first end, an extending portion proximate a second end, a passage formed axially through the extension fitting, and a socket configured to receive a directional ball type nozzle held therein by a locking ring;

inserting the first end of the extension fitting into the base socket so that the extending portion extends above the initial surface of the wall;

applying a plaster-based resurfacing material atop the initial surface; and embedding the extending portion so that the second end is substantially flush with a new surface of the plaster-based resurfacing material.

15. An extension fitting for use in pool resurfacing where a plaster-based resurfacing material is applied atop a surface of a wall of a pool, the extension fitting configured for attachment to a base fitting permanently embedded within the wall, the base fitting configured to deliver water to the pool, the extension fitting comprising:

a first portion configured for insertion into the base fitting;

an extending portion configured to extend externally from the base fitting when the first portion is inserted within the base fitting, a width of the extending portion configured to correspond to a thickness of the plaster-based resurfacing material;

a passage formed axially through the extension fitting to permit water to flow from the base fitting and through the extension fitting to be delivered to the pool; and a socket configured to receive a nozzle, the socket configured to receive a locking ring to retain the nozzle;

wherein, when the plaster-based resurfacing material is applied to the surface of the wall, the first portion is inserted in the base fitting and the extending portion is embedded within and surrounded by the plaster-based resurfacing material.

16. The extension fitting of claim 15 wherein an internal thread is formed on the inner diameter of the extending portion, configured to threadably receive the locking ring.

17. The extension fitting of claim 16 wherein the internal thread is of sufficient depth to permit the locking ring to be recessed within the extending portion.

18. The extension fitting of claim 15 wherein an external thread is formed on the first portion, the external thread configured to engage a locking ring thread on the base fitting.

* * * * *